United States Patent [19]

Stanfield

[11] 4,139,952

[45] Feb. 20, 1979

[54] APPARATUS AND METHOD FOR DRYING SEED CORN BY BURNING COBS

[75] Inventor: Zenas A. Stanfield, Bloomington, Ill.

[73] Assignee: Ciba-Geigy Corporation, Ardsley, N.Y.

[21] Appl. No.: 832,580

[22] Filed: Sep. 12, 1977

Related U.S. Application Data

[63] Continuation-in-part of Ser. No. 701,734, Jun. 30, 1976, Pat. No. 4,064,638.

[51] Int. Cl.[2] ..... F26B 7/00; F26B 7/12

[52] U.S. Cl. ..... 34/12; 34/34; 34/174; 34/175; 34/218; 34/237

[58] Field of Search ..... 34/12, 34, 174, 218, 34/237

[56] References Cited

U.S. PATENT DOCUMENTS

| | | | |
|---|---|---|---|
| 3,526,969 | 9/1970 | Alms et al. | 34/174 X |
| 3,559,299 | 2/1971 | Tyler | 34/12 |
| 3,896,562 | 7/1975 | Zimmerman | 34/174 |
| 4,020,561 | 5/1977 | Mathews | 34/174 X |
| 4,076,492 | 2/1978 | Alms et al. | 34/174 X |

FOREIGN PATENT DOCUMENTS

| | | | |
|---|---|---|---|
| 1208603 | 10/1970 | United Kingdom | 34/34 |

*Primary Examiner*—Leland A. Sebastian
*Attorney, Agent, or Firm*—Wenderoth, Lind & Ponack

[57] ABSTRACT

An apparatus and method for drying seed corn using cobs and unusable seed corn as fuel for heating the drying medium for drying the seed corn. Products of combustion from an incinerator for incinerating cobs is supplied to a heat exchange medium circulating apparatus having a first heat exchanger and a series of second heat exchangers connected in parallel with each other and in series with the first heat exchanger, and a means for circulating a heat exchange medium through the circulating apparatus for heating the heat exchange medium. A plurality of ear corn dryers for drying seed corn in the form of ear corn each have a gaseous drying medium circulating apparatus control system for alternately circulating a gaseous drying medium in opposite directions through the dryers. Each drying medium circulating apparatus is connected to one of the second heat exchangers for recirculating said gaseous drying medium through the second heat exchanger after it has been circulated through the dryer. A sheller connected to the dryer receives the dried ear corn from the dryer and shells and the cobs are cycled to the incinerator as fuel therefor.

8 Claims, 5 Drawing Figures

APPARATUS AND METHOD FOR DRYING SEED CORN BY BURNING COBS

This is a continuation-in-part application of Ser. No. 701,734 filed June 30, 1976, now U.S. Pat. No. 4,064,638.

This invention relates to a method of and an apparatus for drying seed corn, and more particularly to such a method and apparatus which makes possible the use of cobs and unusable seed corn produced as a by-product of the production of the seed corn as fuel for heating the drying medium for drying the corn.

BACKGROUND OF THE INVENTION AND PRIOR ART

The commercial drying of seed corn is relatively well-developed art. It differs from the drying of feed corn in that it must be more precisely controlled since the moisture content of the kernels of corn for best removal from the ear is critical and overdrying must be avoided in order to avoid damaging the kernels so that they will withstand storage until they are planted, and so that they will have good emergence and growth characteristics.

There are two well-known methods of drying seed grain, such as seed corn, which are known as the bin-layer dryer method and the batch-in-bin method. The former utilizes a bin to which a duct is led which has a fan and a heater unit, and the system dries the granular material by forcing heated air through a perforated bottom floor of the bin and upwardly through the successive layers of the granular material which have been added to the bin, thereby absorbing moisture and thus reducing the moisture content of the seed material in the bin.

Obviously the layers placed in the bin early in the operation will be reheated several times during the drying of the layer added later. Moreover, this bin layer dryer system requires a substantial amount of time to dry a full bin of granular material, and there is always the danger of overheating or overdrying the material in the lower layers.

The batch-in-bin dryer system is an improvement on the bin layer dryer method, and in this method a single layer is dried on the perforated floor of the dryer bin, by passing the heated air through the layer and then the dried material is transferred to a storage bin. In more recently built systems of this type, the flow of the heated air may be reversed, i.e. being passed from the top of the bin down through the granular material in the bin and out through the perforated bottom 4. This overcomes the disadvantages of the bin-layer dryer method in that each batch is subjected to drying only once. However, one of the disadvantages of this system is that an entire batch must be dried before any of it can be removed or replaced by a new batch.

Moreover, both of these systems, in actual practice, are operated with a plurality of bins in parallel and housed in a single building with large passages therethrough for the gaseous drying medium. Each bin is filled, and then the heated air from a single source of heated air consisting of a heater and a blower is directed in parallel through the bins. Manifestly, this requires a large capacity heating system and blower system, and a relatively strong building to withstand the rather high air pressures generated by such a large blower system. The passages into the respective sections are provided with dampers. Therefore, if the seed material, for instance seed corn, which is coming from the fields, is not sufficient to fill all of the bins in a particular section of the building in which the bins are housed, the excess heated air passed through the filled, partially filled, or unfilled bins is not utilized, and heat is thus wasted.

Further, the fuel utilized in heating the air has generally been natural gas or the like, which is simply burned in the ambient air and drawn immediately into the blower for distribution to the various systems of bins. Natural gas has heretofore been readily available at a low price, and since it produces a very clean product of combustion, it is well-suited to the heating of air for the purpose of drying seed materials.

Natural gas does have the disadvantage that it produces amounts of water vapor as products of combustion which have some significance in the overall drying operation, particularly seed corn, since this amount of water vapor is relatively large in comparison to the amount of water vapor removed from the seed material. However, the cost of natural gas has heretofore been so low that this disadvantage is not so significant that efforts to overcome it would have been justified from an economic standpoint.

More recently, efforts have been made to provide dryers for granular agricultural products which are similar to continuous flow dryers for particulate material, but which nevertheless handle the agricultural materials one batch at a time, although they are automatically fed into the dryer structures and automatically removed therefrom. One such apparatus is disclosed in U.S. Patent 3,634,949 to Robert A. Louks. In this apparatus, a cylindrical housing is provided with a downwardly directed cone having a perforated wall portion at the lower part thereof, and a second smaller perforated cone is positioned within the first cone near the bottom thereof to define an annular conical space therebetween. Grain is fed into this space, and in the actual Louks arrangement, which is a true continuous-flow dryer, as the grain moves down the space to the bottom of the outer cone, warm air is forced across the annular conical space through the perforated wall portions to dry the grain moving along the cones.

While this apparatus is readily adaptable for drying such grains as feed corn, it does not permit the rapid emptying and self-cleaning required in the drying of seed grain, and particularly seed corn in the ear.

Moreover, in this apparatus, the source of fuel for heating the air for the drying operation would still be a natural gas or the like, since the air is directed directly from the heater and the blower through the system into the cylindrical housing.

Among various steps taken to overcome the recent problem of the decreasing availability of natural gas as a drying medium, efforts have been made to burn the cobs from which the seed corn has been shelled as the fuel for heating the air used as the drying means for the seed corn. These efforts have involved placing the gaseous products of combustion from the cob directly into the air to be heated, i.e. mixing the gaseous products of combustion and the ambient air to form a gaseous drying medium, and directing this drying medium over the corn, either in the conventional drying bins or in the bins which are set up in the form of a continuous dryer.

The heat content of the cobs is just about sufficient for the drying of the seed corn by the conventional drying method and apparatus now available in the art. It has been found that in the conventional method and apparatus, particularly the batch-in-bin method and apparatus, the amount of heat necessary per bushel of corn dried from the normal moisture content as it comes from the field to the desired moisture content for shelling, namely from about 30% to a range of from 12–13%, is 70,000 btu per bushel. This is substantially the same amount of heat which can be obtained from burning the cobs from which the bushel of seed corn has been removed. It therefore appears that if all of the heat from the cobs can be added to the drying medium, it will be possible to obtain a successful method and apparatus in which all of the fuel necessary for drying the corn is obtained from the cobs.

However, this solution of the fuel problem is not believed to be a workable solution. In the first place, particulates are added to the gaseous drying medium from the combustion of the cobs, and while the larger particulates can be readily removed by conventional equipment, the smaller particulates are rather difficult to remove without rather high costs for equipment and operation. In many of the installations, particularly the bin-type installations described above, personnel work in the air tunnels closing and opening the dampers to the passages leading to the bins to control the flow of the drying medium. There can be no assurance that the particulate levels in the drying medium will be such as not to injure these personnel.

More important, however, it has been found that the particulates produced during the combustion of the cobs are high in potassium, and when these particulates are directed onto the seed corn, it is believed that they may damage the emergence characteristics of the seed when the seed is planted.

Thus, since the direct mixing of the products of combustion of the cobs into the drying air, which is the only way to add all of the heat of combustion to the drying air, can cause damage both to the personnel operating the systems as well as to the corn itself, it appears that a method and apparatus in which the cobs are utilized for the entire amount of fuel necessary to dry the corn cannot be used. In fact, it appears that even if the danger to personnel could be overcome, for example by the use of gas masks or rearranging the controls for the dampers, nevertheless the burning of cobs and the heating of the drying medium in the conventional manner from the products of combustion of the burning of the cobs should be avoided due to the possible damage of the seed corn with respect to its emergence characteristics. It would thus seem that only indirect heating of the gaseous drying medium would avoid the problems of direct heating, and of course this involves a heat loss which means that the cobs will not serve as the source of all the heat needed.

Another aspect of the problem of burning the cobs is that while cobs are an economical source of heat, they are also a marketable item. However, there is a by-product of seed corn production which is unmarketable, namely unsatisfactory seed corn. By this term is meant seed corn which is no longer sufficiently fresh to germinate with the desired consistency, i.e. outdated seed corn, and seed corn which is found after processing to germinate unsatisfactorily even though freshly dried. Such corn is estimated to be about 5% of any given crop of seed corn. Such corn cannot be sold for animal feed, since it has been treated with fungicide and the fungicide cannot be sufficiently completely removed to make such corn acceptable as a feed. Such corn can however be burned without impermissible atmospheric contamination.

It would therefore be a significant advance in the art to have a method and apparatus which can obtain all of the fuel necessary for the drying operation from the cobs and the unsatisfactory seed corn, and nevertheless avoid the problems of particulates in the drying medium, both from the standpoint of lack of danger to the operating personnel and avoidance of contact of the potassium containing particulates with the seed corn being dried.

OBJECTS AND BRIEF SUMMARY OF THE INVENTION

It is an object of the present invention to provide a method of and an apparatus for drying seed corn in which all of the fuel for heating the drying medium can be obtained from burning of cobs or a mixture of cobs and unsatisfactory seed corn.

It is a further object of the present invention to provide a method of and an apparatus for drying seed corn in which the products of combustion of the burning cobs and corn are used to heat a heat-exchange medium, which in turn is used to heat air for drying the seed corn, thereby avoiding direct contact of the products of combustion of the burning of the cobs or corn with the seed corn.

It is a further object of the present invention to provide a method and an apparatus for drying seed corn by which the amount of heat necessary to dry the corn is substantially reduced, so that even though there is a heat loss in a heat exchange operation, the amount of heat supplied from the burning of the cobs is nevertheless sufficient for heating a heat exchange medium which in turn is used to heat a gaseous drying medium for drying the seed corn. Alternatively the method and apparatus should be efficient enough to dry the seed corn by a mixture of available unsatisfactory seed corn plus a minimum amount of cobs, thereby leaving a maximum amount of cobs available for sale as a useful by product of the seed corn production process.

BRIEF DESCRIPTION OF THE FIGURES

These and other objects will become apparent from the following specification, taken together with the accompanying drawings, in which.

DETAILED DESCRIPTION OF THE INVENTION

Figure 1:
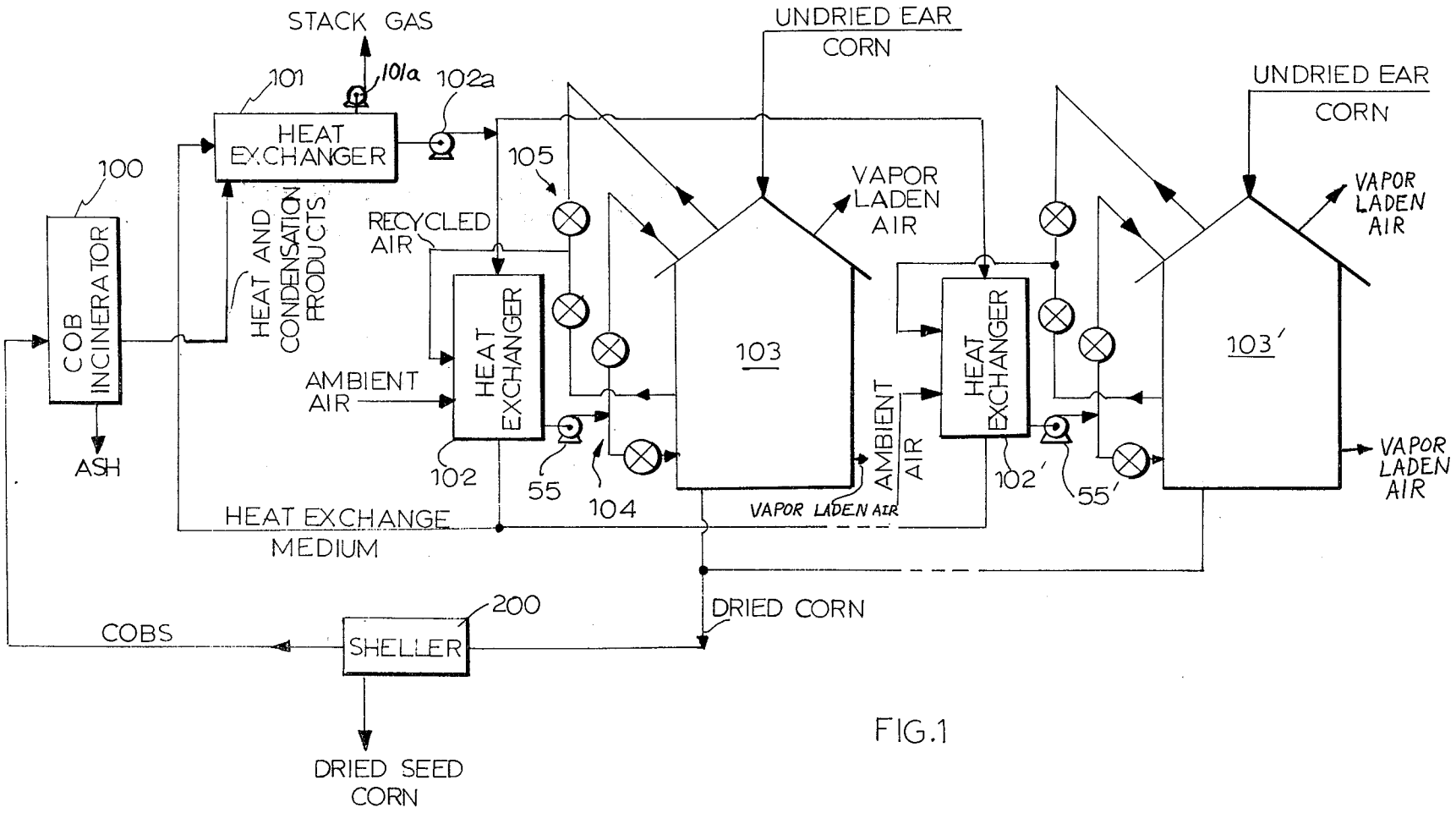
FIG. 1 is a diagram of a system for drying seed corn according to the present invention.

As shown in FIG. 1, the apparatus comprises a cob incinerator 100 for burning cobs or a mixture of unsatisfactory seed corn and cobs and producing heat and combustion products. It will of course be understood that at the beginning of the drying season in the fall, at which time the seed corn reaches the correct stage of maturity, cobs must be obtained from the last batch of corn which was dried in the preceding season and unsatisfactory seed corn from batches dried in preceding seasons. Thereafter, cobs from the current crop can be obtained directly from the sheller 200, which shells the dried kernels of corn from the dried ear corn received from the dryer apparatus.

The heat and combustion products from the burning of the cobs or cobs and corn in the incinerator 100 are passed through a first heat exchanger 101, for example, by a blower 101*a* and then passed off as stack gas. A heat exchange medium is passed through a heat exchange medium circulatory system made up of the heat exchanger 101 and second heat exchangers 102, 102', etc., for example by a pump 102*a*. This heat exchange medium can be any available heat exchange medium, but preferably is liquid, and more preferably is water. Thus, the cob incinerator 100 and heat exchanger 101 can be constituted by a simple burner and boiler arrangement. The heat exchanger 102 is associated with the first dryer 103 of a series of driers 103, 103' . . . which is here shown as a generally cylindrical bin dryer to which undried ear corn is fed through the peak of the roof thereof, and from which the dried ear corn is removed at the base thereof and sent to the sheller 200. Similar heat exchangers 102' are associated with the rest of the series of driers, only the dries 103' of which is shown. The drier will be described in detail hereinafter.

At each dryer, ambient air is passed through the heat exchanger 102 and supplied to the air distribution system generally indicated at 104 for feeding, under the control of a damper system generally indicated by symbols for valves, into the bottom of the dryer 103 for upward flow through the corn therein, or to the top of the dryer 103 for flow downwardly through the corn therein. A drying medium recycling system generally indicated at 105 receives the air which has flow upwardly through the corn or downwardly through the corn, and recycles it through the heat exchanger 102. Arrangements are made in the dryer for discharging vapor laden air periodically or continuously from the system.

The heat exchange medium from the second heat exchangers 102, 102', etc. is circulated back through the heat exchanger 101 in a closed cycle, and the heat and combustion product from the cob incinerator 100 are likewise passed through the heat exchanger 101 to heat the heat exchange medium.

As pointed out above, the dryer 103 must be such that it can carry out drying of a batch of ear corn with an amount of heat which is less than the amount of heat which is obtained from the burning of the cobs remaining from the batch after the batch has been shelled, due to the loss of heat in the heat exchangers.

To this end, the dryer has a particular structure, which will be described in connection with FIGS. 2–5.

Figure 2:
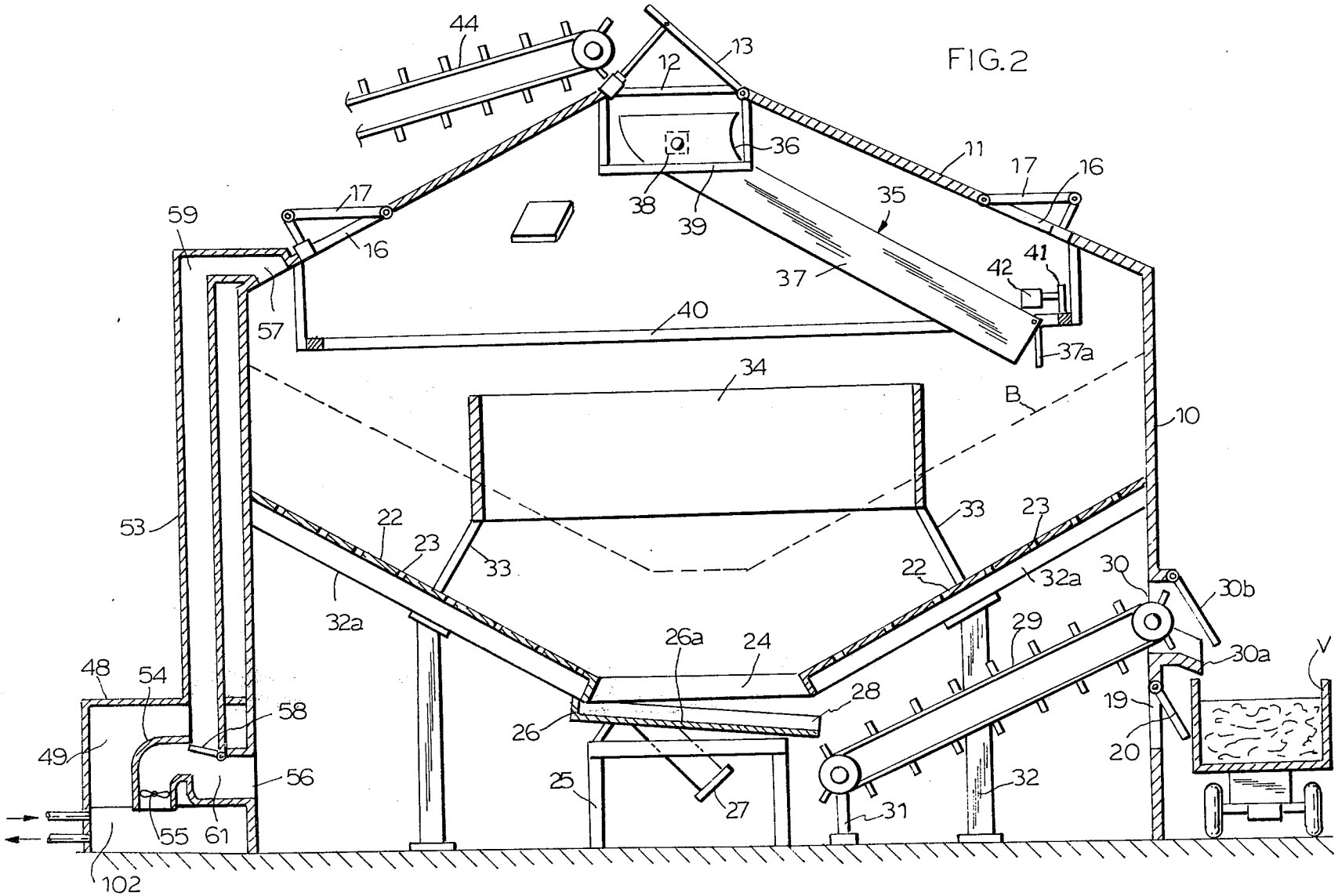
FIG. 2 is a sectional elevation view of a seed grain dryer particularly suited for use in the system of the present invention.
Figure 4:
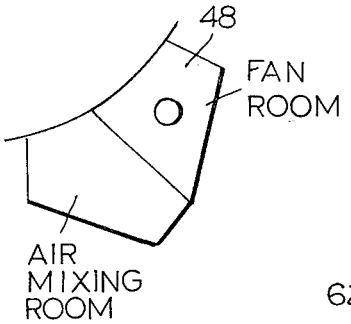
FIG. 4 is a plan view of the portion of the dryer shown in FIG. 3.

As shown in FIG. 2, the dryer for use in the system according to the present invention has a housing defined by a generally cylindrical outer wall 10 and an upwardly pointed conical roof 11 having an opening 12 at the top center thereof. A hatch cover 13 over the opening 12 is located so as to be movable from a position as shown in FIG. 1, in which the opening 12 is open, to a position in which the opening 12 is closed.

Hatches 16 are provided at points spaced around the roof 11 and are opened and closed by hatch covers 17. Similar hatches 19 are provided in the cylindrical wall 10 and are closed by hatch covers 20 which can be braced in the open position. It is clear that automatic remote control hatch cover actuating means can be provided for each hatch cover or operated manually or remotely by ropes, wires or other means.

Within the lower portion of the housing is a downwardly inclined perforated conical wall 22 having a large number of evenly distributed perforations 23 therein, and having a downwardly directed opening 25 at the bottom thereof. The conical wall 22 is supported at points spaced inwardly from the cylindrical wall 10 by posts 32 and beams 32A placed at intervals around the interior of the housing.

Beneath the opening 24 is a support frame 25 which supports a three-sided pan 26 inclined in the direction of the open end 28 thereof. Attached to the bottom of the pan 26 is a conventional vibrator device 27 driven by a power source (not shown) for vibrating only the pan 26 generally in a direction parallel to the bottom 26*a* thereof. The vibrator device 27 does not vibrate the wall 22.

A discharge conveyor 29 extends from beneath the open end 28 of the pan 26 upwardly and toward the cylindrical wall 10 to a discharge opening 30. The lower end of the conveyor 29 is mounted on a stand indicated generally at 31, while the upper end can be attached to the cylindrical wall 10 adjacent the opening 30. A discharge chute 30*a* extends outwardly from the outer surface of the wall 10 beneath discharge opening 30, and a hatch cover 30*b* closes the opening 30 when the conveyor 29 is not operating.

A baffle member can be provided within the housing desired. The baffle is mounted above the conical wall 22 within the housing on supports 33 extending upwardly from the conical wall 22. The baffle is a cylindrical or ring-shaped baffle 34 which extends downwardly toward the conical wall 22 and has the lower edge thereof spaced from the conical wall 22.

A distributing chute 35 is rotatably mounted just beneath the roof 11, and consists of an upwardly opening funnel-shaped receiving portion 36 and a tubular distributing pipe 37 extending from the bottom of the funnel-shaped receiving portion 36 downwardly and laterally toward the cylindrical wall 10, stopping at a point spaced slightly from the cylindrical wall 10. A pivoted gate 37A on the end of pipe 37 and which may be of rubber, prevents the corn from hitting the wall 10 and makes the corn drop straight down or nearly so. The funnel-shaped receiving portion is pivotally mounted on bearings 38 supported on a ring 39 for turning 360°. A track 40 around the periphery of the bin 10 supported from top 11 supports a motor driven device 42 running on wheels 41 on tracks 40 and which turns chute 37 around the bin 360° and for supporting the distributing chute 37 in the position shown.

A feed conveyor 44 can be provided above the roof 11 for supplying the material to be dried to the top opening 12 in the roof 11.

The duct system for supplying the gaseous drying medium to the interior of the drier 103 consists of a housing 48 which is attached to the side of the dryer 103, and which has a central wall 49 therethrough essentially dividing the housing into a fan space and an air mixing space 50 and 51, respectively. Extending from the fan room is a vertical distributing duct 53 into which opens a curved fan hood 54 containing a fan 55. The hood opens downwardly so as to draw air from within the fan space 50 into the hood 54 and to deliver it to the vertical duct 53. The lower end of the vertical duct 53 opens at 56 into the lower portion of the dryer housing 10 below the conical wall 22, and the upper end opens at 57 through the roof 12 of the dryer into the space above the conical wall 22. Within the vertical duct 53 is a damper 58, which can swing from an upper position in which it blocks the entry to the upper portion of the vertical duct 53 to a lower position in which it blocks entry to the lower portion of the vertical duct 53. It will thus be seen that with the duct 58 in the upper position, the air will be forced by the fan 55 through the hood 54 and downwardly through the lower portion of the duct 53 and through the opening 56 into the lower portion of the dryer. With the damper 58 in the lower position, the air will be forced upwardly through the upper portion of the vertical duct 53 and through the opening 57 into the upper portion of the housing 10.

In the wall 49 dividing the air mixing space and the fan space is the heat exchanger 102 as described in connection with FIG. 1. This can be a radiator through which the air is drawn by the fan 55 so as to pass the air over the portions of the radiator containing the heated heat exchange medium.

A return duct 60 extends laterally from the opening 59 at the upper end of the vertical duct 53 and then downwardly into the roof of the housing 48 and opens into the air mixing space 51. A similar duct (not visible) extends from the opening 61 at the lower end of the vertical duct 53 laterally through the wall 49 into the air mixing space 51. It will be understood that with the damper 58 in the raised position, and with the air which has been drawn through the exchanger flowing downwardly and into the lower portion of the dryer, the air from the upper portion of the dryer will flow reversely through the opening 57 and the opening 59 and through the duct 60 into the air mixing space 51. Conversely, with the damper 58 in the lowered position, the air will be forced from the lower portion of the dryer through the openings 56 and 61 and through the lateral duct into the air mixing space 51. Thus, air is recirculated through the heat exchanger from the portion of the dryer housing 10 which is downstream in the direction of the flow of the heated drying medium through the layer of ear corn on the conical wall 22.

The operation of the apparatus will now be described with reference to drying ear corn which is eventually to be shelled to obtain seed corn. In this operation, a batch of ear corn is fed by means of converyor 44 into the apparatus through the opening 12. It is received by the distributing chute 35 and directed to the peripheral portion of the interior of the apparatus. The distributing chute 35 is rotated around the central vertical axis of the apparatus by the motor 42 on tracks 37A so as to distribute the ear corn being supplied to the apparatus evenly around the periphery of the interior of the apparatus. The ear corn first falls on the perforated cone and slides down the conical wall 22 and is stopped at the bottom opening 24 by the pan 26. As more corn is supplied, the corn builds up on the conical wall.

When sufficient ear corn has been supplied to form the bed B, shown in phantom lines, on the conical wall 22, the feed is discontinued.

The baffle 34 usually is not required, but may be added to assist in the formation and maintenance of a uniform depth of bed on the conical wall 22. Moreover, the angle $\alpha$ of the conical wall 22 with respect to the horizontal is between the angle of repose of the material being dried, about 35°–45° for ear corn, and the angle at which the granular material will slide down the conical wall under the effect of gravity, in the case of ear corn about 19°–22°. A typical device has an angle of 25° from horizontal.

After the completion of the supply of the batch of ear corn is completed, the hatch covers 13, 17, 20 and **30*b* are closed, and the damper 58 is moved to one or the other of its positions. If the damper is moved to the upper position, air will first be pumped by the blower 55 downwardly through the vertical duct 53 and through the opening 56 into the lower portion of the housing 10 and then upwardly through the apertures 23 and through the bed B or ear corn lying on the conical wall 22. The heated air thus serves to dry the corn in the bed B. The air having passed through the bed B is then caused to flow through the opening 57 and the opening 59, and through the return duct 60 into the air mixing space, where it is again drawn through the heat exchanger 102 by the blower 55**.

This circulation continues for a predetermined length of time, and the damper 58 is then changed so as to reverse the flow. Again, there will be circulation from above the bed B of ear corn, through the bed, and through the opening 56 and 61 into the mixing space 51, and again through the heat exchanger.

This reversal of flow of the drying medium is repeated periodically until the kernels of corn on the ears have reached the desired moisture content. Usually one period of flow in the upward direction and one period of flow in the downward direction is sufficient.

When the air becomes overly laden with moisture, some of the air is discharged from the housing 10. This is preferably done on the upward flow of air, and one or more of the hatches 17 is opened to permit some of the air to escape. This naturally requires the opening of the door 62 in the mixing space 51 to admit air to replace the air which is being discharged.

It has been found that in an apparatus having a capacity of ear corn which will yield 1500 bushels of said corn, i.e. about 4000 cu. ft. of ear corn in a bed B about 6 ft. thick, and with the drying medium being air heated to a temperature of from 105° to 110° F., the moisture content of the corn on the ears on the top and the bottom of the bed can be brought to 12%, and the moisture content of the corn on the ears at the middle of the bed can be brought to from 12½ to 13%. The volume of air pumped is about 20 cu. ft./min. per bushel of seed corn shelled from the bin, or about 30,000 cu. ft./min. The time for drying is from about 48 hours to about 72 hours, depending on the initial moisture content of the corn.

Figure 3:
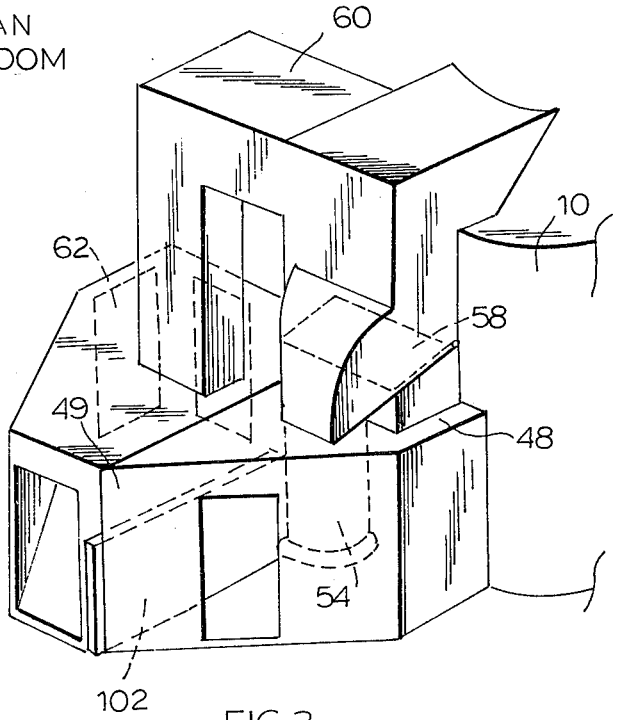
FIG. 3 is a perspective view, partly broken away, of a part of the grain dryer of FIG. 2.
Figure 5:
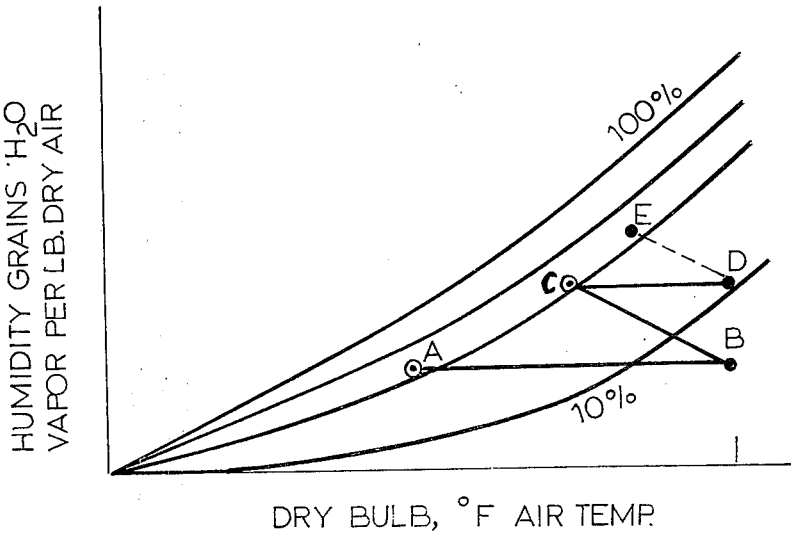
FIG. 5 is a graph showing the manner in which a gaseous drying medium is heated during the flow through the apparatus according to the present invention.

As seen from FIG. 3, which is for air as the gaseous drying medium, ambient air at condition A is heated as it passes over the heat exchanger 102 to the temperature B, which in the preferred manner of operating the apparatus is about 105°–110° F. As it flows through the ear corn, it picks up moisture, while the temperature thereof falls, and it reaches the condition C in which it may have a relative moisture content above that desired for drying the final seed corn.

Where the temperature at point C is above the ambient air temperature, it is recirculated, and it is again passed over the heat exchanger 102, and it is changed to the condition D in which the temperature in increased, and the relative moisture content is reduced again. It then again passes through the bed B, in which the moisture content is increased and the temperature again falls.

It will be seen that the amount of heat which must be added to the gaseous drying medium is reduced by the difference between the amount of heat necessary to reheat the recycled drying medium and the amount necessary to heat the same amount of incoming medium to the same temperature. Thus, if the recycled air is returned to the heat exchanger at about 80° after having passed through the bed of corn, the amount of heat necessary to reheat to the drying temperature of about 110° is substantially less than the heat necessary to reheat a completely new body of air from an ambient temperature, for example of 40° F. to 110° F. In addition, it is of course necessary to heat the air added to replace discharged moisture laden air from the ambient temperature to the drying temperature.

After drying to the desired moisture content, the heat is turned off and fresh air at ambient temperature is blown through the seed long enough to cool the seed prior to shelling and bulk storage. This protects the vigor of the seed and seed quality and reduces the energy otherwise used to cool the bulk seed corn stored in a warehouse.

After drying to the desired moisture content and cooling, the vibrator 27 is actuated for vibrating the pan 26 for continuously feeding dried ears of corn through the open bottom end 28 of the pan onto the discharge conveyor 29, by which the ears with the dried corn thereon are conveyed out through the discharge opening 30 and into a means for conveying the ears of corn to a shelling apparatus 200, for example a vehicle V or a conveyor. The vibrator can be a commercially available device vibrating at a frequency of 60 cycles/sec. with a displacement of approximately 0.055 to 0.06 inches, and can move about 50 tons/hr. along the pan onto the conveyor 29.

After the apparatus is empty, a new batch of ear corn is fed in and the drying cycle is repeated.

In the sheller 200, the dry corn is shelled, then the dried seed corn removed and packaged for sale. The cobs, which are now substantially dry, are cycled to the cob incinerator 100 to serve as the fuel therein.

It has been found that by proper operation of each dryer, the amount of heat necessary to dry the corn, as compared with prior art systems, can be reduced substantially, depending upon the conditions of the ambient air.

Therefore, although the heat produced by the burning of the cobs is only enough to dry an equivalent amount of ear corn by the prior art methods when the heat is added directly to the gaseous drying medium, in the present method and apparatus, because of the increased efficiency of each dryer, it is possible to heat the gaseous drying medium indirectly, despite the loss of heat in such a step, so as to keep the products of combustion and the particulates from the burned cobs out of contact with the gaseous drying medium, and consequently out of contact with the corn, and yet nevertheless obtain all the heat necessary for the drying operation from the cobs left over after shelling of the dried ear corn.

Alternatively, because of the increased efficiency of the dryer it is possible to heat the gaseous drying medium indirectly with the above advantages while obtaining all of the heat from unsatisfactory seed corn plus a minimum amount of cobs, thereby maximizing the amount of cobs available for sale as a useful byproduct and thus minimizing the overall net cost of the seed corn production process.

The method and apparatus are very efficient despite the carrying out of two heat exchange steps, i.e. the heating of the liquid heat exchange medium from the gaseous products of combustion and the heating of the gaseous drying medium from the liquid heat exchange medium. This enables the use of hot water pipes or the like to carry the liquid heat exchange medium from a boiler to a series of dryers, which may be standing in side-by-side rows several hundred feet long. This is a simple apparatus to construct and operate. The capital costs and operating problems of heating the gaseous drying medium indirectly from the products of combustion and conducting it in sufficient quantities and at sufficiently high temperatures to such an array of dryers would be prohibitive.

Moreover, the provision of a heat exchanger at each dryer makes is possible to close down operation of a dryer for one reason or another and reduce the overall load on the system, which consequent reduction in the amount of fuel burned.

What is claimed is:

1. An apparatus for drying seed corn using cobs or a mixture of cobs and unsatisfactory seed corn as fuel for heating the drying medium for drying the seed corn, said apparatus comprising an incinerator for incinerating cobs or a mixture of cobs and unsatisfactory seed corn, a heat exchange medium circulating means having a first heat exchanger and at least one second heat exchanger connected in series and a means for circulating a heat exchange medium through said circulating means a combustion product circulating means connected between said incinerator and said first heat exchanger for circulating the products of combustion from said incinerator to said first heat exchanger for heating the heat exchange medium, at least one ear corn dryer for drying seed corn in the form of ear corn, a gaseous drying medium circulating means connected to said dryer having means for alternately circulating a gaseous drying medium in opposite directions through said dryer, said gaseous drying medium circulating means being connected to said at least one second heat exchanger for recirculating said gaseous drying medium through said second heat exchanger after it has been circulated through said dryer, and a sheller connected to said dryer for receiving the dried ear corn from the dryer and shelling it and for discharging cobs for use in said incinerator.

2. An apparatus as claimed in claim 1 in which there are a plurality of dryers each having a gaseous drying medium circulating means, and said heat exchange medium circulating means has a plurality of second heat exchangers connected in parallel, one for each gaseous drying medium circulating means.

3. An apparatus as claimed in claim 1 in which said gaseous drying medium is air, and said second heat exchanger has an air intake connected to said gaseous drying medium circulating means for supplying additional drying air to said dryer, and said dryer has an air exhaust for exhausting vapor laden air therefrom.

4. An apparatus as claimed in claim 1 in which said dryer comprises:

a cylindrical housing having a roof thereon with an aperture at the center of said roof, said housing having closable openings therein, one of which is a discharge opening in the side of said housing;

a downwardly directed conical wall filling the entire internal cross-section of said housing and having a plurality of perforations distributed evenly therein and having an opening at the bottom thereof;

an open sided pan beneath said bottom opening of said conical wall and inclined toward said open side;

a vibrator operatively associated with said pan for vibrating said pan in a direction parallel to the bottom of said pan;

a discharge conveyor in said housing having one end beneath the open side of said pan and the other end at said discharge opening;

a distributing chute in the upper part of said housing above said conical wall and having a funnel-shaped receiving portion beneath the opening of said roof and a distributing pipe extending from the bottom of said funnel-shaped receiving portion downwardly and outwardly from the center of said housing to adjacent the interior periphery of said housing;

a distributing chute rotating means coupled to said distributing chute for rotating said distributing chute with said funnel-shaped receiving portion beneath said opening in said roof and the end of the distributing pipe moving around the periphery of said housing; and said gaseous drying medium circulating system comprises:

a lower gaseous drying medium flow pipe opening into said housing below said conical wall circulating system;

an upper gaseous drying medium flow pipe opening into said housing through said roof; and a blower and ducts extending from said lower and upper flow pipes to said heat exchanger and said blower and having dampers therein for directing the gaseous drying medium.

5. A method of drying seed corn by using cobs as a fuel for heating the drying medium for drying the seed corn, said method comprising incinerating cobs from which seed corn has been shelled, heating a heat exchange medium with the products of combustion of the cobs, passing a gaseous drying medium in heat exchange relationship with the heated heat exchange medium, passing the thus heated gaseous drying medium through seed corn on the cob in the form of ear corn alternatively in opposite directions for drying the seed corn, recirculating the gaseous drying medium in heat exchange relationship with the heat exchange medium for reheating it, and, after the seed corn is sufficiently dry, shelling the seed corn from the ears of seed corn and cycling the cobs remaining to the incinerating step.

6. A method as claimed in claim 5 in which a portion of the gaseous drying medium which has taken up an excessive amount of moisture is discharged, and fresh gaseous drying medium is passed in heat exchange relationship with the heat exchange medium and added to the previously heated gaseous drying medium to make up the amount of gaseous drying medium which has been discharged.

7. A method as claimed in claim 5 further comprising, after the seed corn is sufficiently dry and prior to the shelling, circulating a gaseous medium at ambient air temperature through the dried corn for cooling it.

8. A method as claimed in claim 5 further comprising incinerating unsatisfactory seed corn with said cobs, whereby the amount of cobs which must be burned to obtain the necessary heat is minimized.

* * * * *